US008591002B2

(12) United States Patent
Shimizu et al.

(10) Patent No.: US 8,591,002 B2
(45) Date of Patent: Nov. 26, 2013

(54) IMAGE FORMING APPARATUS INCLUDING CARRIAGE THAT MOUNTS IMAGE FORMING UNIT

(75) Inventors: Kenji Shimizu, Kanagawa (JP); Takayuki Nihara, Kanagawa (JP); Shinichiro Naruse, Kanagawa (JP); Soichi Saiga, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 79 days.

(21) Appl. No.: 13/225,737

(22) Filed: Sep. 6, 2011

(65) Prior Publication Data

US 2012/0056936 A1 Mar. 8, 2012

(30) Foreign Application Priority Data

Sep. 8, 2010 (JP) ..... 2010-201461
May 27, 2011 (JP) ..... 2011-119477

(51) Int. Cl.
*B41J 19/00* (2006.01)

(52) U.S. Cl.
CPC ..... *B41J 19/005* (2013.01)
USPC ..... 347/37

(58) Field of Classification Search
CPC ..... B41J 19/005
USPC ..... 347/37; 400/335, 319
See application file for complete search history.

(56) References Cited

U.S. PATENT DOCUMENTS

| | | | | | |
|---|---|---|---|---|---|
| 4,203,680 | A | * | 5/1980 | Mitrovich | 400/335 |
| 5,629,725 | A | * | 5/1997 | Buican | 347/37 |
| 5,966,147 | A | * | 10/1999 | Matsui | 347/37 |
| 2009/0136254 | A1 | | 5/2009 | Niihara et al. | |
| 2010/0231643 | A1 | | 9/2010 | Saiga et al. | |

FOREIGN PATENT DOCUMENTS

| | | | |
|---|---|---|---|
| JP | 03234686 | A * | 10/1991 |
| JP | 2002-168298 | | 6/2002 |
| JP | 3787510 | | 3/2006 |
| JP | 2007-152605 | | 6/2007 |

* cited by examiner

*Primary Examiner* — Shelby Fidler
(74) *Attorney, Agent, or Firm* — Cooper & Dunham LLP

(57) ABSTRACT

An image forming apparatus includes a carriage movably supported to move reciprocally in a main scanning direction, an image forming unit mounted on the carriage to form an image, a driving pulley disposed at a first end in the main scanning direction, a driven pulley disposed at a second end opposite the first end in the main scanning direction, a driving source operatively connected to the driving pulley to rotate the driving pulley, a carriage drawing member extended between the driving pulley and the driven pulley and partially mounted to the carriage to draw the carriage, a mount disposed on the carriage to mount the carriage drawing member, a holder disposed on the carriage to hook the carriage drawing member extended from the mount during assembly, and a guide member to guide the carriage drawing member extended from the mount and the holder.

6 Claims, 7 Drawing Sheets

IMAGE FORMING APPARATUS INCLUDING CARRIAGE THAT MOUNTS IMAGE FORMING UNIT

CROSS-REFERENCE TO RELATED APPLICATIONS

This patent application is based on and claims priority pursuant to 35 U.S.C. §119 to Japanese Patent Application Nos. 2010-201461, filed on Sep. 8, 2010 and 2011-119477, filed on May 27, 2011 in the Japan Patent Office, each of which is hereby incorporated herein by reference in its entirety.

TECHNICAL FIELD

This disclosure relates to an image forming apparatus, and more specifically to an image forming apparatus including a carriage that mounts an image forming unit.

DESCRIPTION OF THE BACKGROUND ART

Image forming apparatuses are used as printers, facsimile machines, copiers, plotters, or multi-functional devices having two or more of the foregoing capabilities. As one type of image forming apparatus employing a liquid-ejection recording method, an inkjet recording apparatus is known that uses a recording head (liquid-droplet ejection head) for ejecting droplets of ink. During image formation, such liquid-ejection-type image forming apparatuses eject droplets of ink or other liquid from the recording head onto a recording medium to form a desired image.

As one sub type of such liquid-ejection-type image forming apparatus, a serial-type image forming apparatus is known that has a carriage mounting the recording head (liquid ejection head) serving as an image forming unit. Such a serial-type image forming apparatus forms an image by ejecting droplets from the recording head while moving the carriage mounting the recording head in a main scanning direction and intermittently feeding the recording medium in a sub-scanning direction perpendicular to the main scanning direction.

Such a serial-type image forming apparatus typically has a main scanning mechanism (carriage scanning mechanism) to move the carriage mounting the image forming unit for scanning in the main scanning direction. The main scanning mechanism includes a driving source, a driving pulley mounted to the driving source, a driven pulley driven by rotation of the driving pulley, and an endless timing belt extended between the driving pulley and the driven pulley and serving as a drawing member to draw the carriage partially fixed on the timing belt.

For example, for an image forming apparatus capable of forming images on large widths of recording media, a long-size timing belt is used as the drawing member and the carriage moves a relatively long distance during main scanning. Because a long-size endless belt compatible with image formation on large-width media costs much, it is conceivable to use an open ended belt (i.e., belt having ends) instead of the endless belt.

In a case in which the carriage scanning mechanism uses such a long-size drawing member, when the carriage mounted on the drawing member is moved along the guide member for installation, the drawing member may conflict with components of the carriage scanning mechanism, thus hampering smooth installation of the carriage and the drawing member.

Consequently, the working efficiency in the installation of the long-size drawing member may decrease.

BRIEF SUMMARY

In an aspect of this disclosure, there is provided an image forming apparatus including a carriage, an image forming unit, a driving pulley, a driven pulley, a driving source, a carriage drawing member, a mount, a holder, and a guide member. The carriage is movably supported to move reciprocally in a main scanning direction. The image forming unit is mounted on the carriage to form an image. The driving pulley is disposed at a first end in the main scanning direction. The driven pulley is disposed at a second end opposite the first end in the main scanning direction. The driving source is operatively connected to the driving pulley to rotate the driving pulley. The carriage drawing member is extended between the driving pulley and the driven pulley and partially mounted to the carriage to draw the carriage. The mount is disposed on the carriage to mount the carriage drawing member. The holder is disposed on the carriage to hook the carriage drawing member extended from the mount during assembly. The guide member guides the carriage drawing member extended from the mount and the holder.

BRIEF DESCRIPTION OF THE SEVERAL VIEWS OF THE DRAWINGS

The aforementioned and other aspects, features, and advantages of the present disclosure would be better understood by reference to the following detailed description when considered in connection with the accompanying drawings, wherein.

Figure 1:
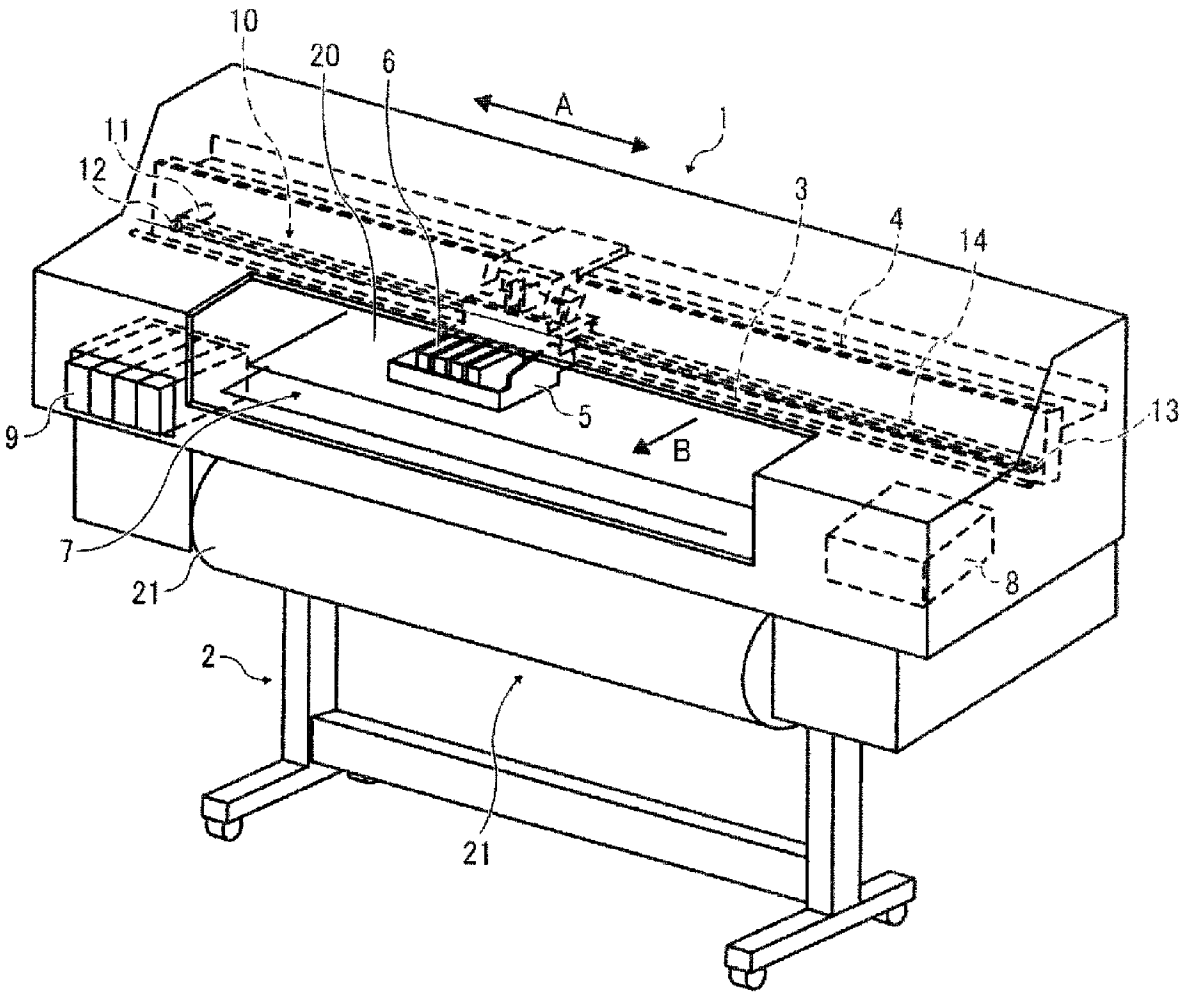
FIG. 1 is a perspective view of an inkjet recording apparatus as an image forming apparatus according to an exemplary embodiment of this disclosure.

The accompanying drawings are intended to depict exemplary embodiments of the present disclosure and should not be interpreted to limit the scope thereof. The accompanying drawings are not to be considered as drawn to scale unless explicitly noted.

DETAILED DESCRIPTION OF EXEMPLARY EMBODIMENTS

In describing embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner and achieve similar results.

In this disclosure, the term "image forming apparatus" of liquid ejection type refers to an apparatus that ejects ink or any other liquid on a medium to form an image on the medium. The medium is made of, for example, paper, string, fiber, cloth, leather, metal, plastic, glass, timber, and ceramic. The term "image formation", which is used herein as a synonym for "image recording" and "image printing", includes providing not only meaningful images such as characters and figures but meaningless images such as patterns to the medium. The term "ink" as used herein is not limited to "ink" in a narrow sense and includes anything useable for image formation, such as recording liquid, fixing solution, liquid, and resin. The term "sheet" used herein is not limited to a sheet of paper and includes anything such as an OHP (overhead projector) sheet or a cloth sheet on which ink droplets are attached. In other words, the term "sheet" is used as a generic term including a recording medium, a recorded medium, a recording sheet, and a recording paper sheet. The term "image" used herein is not limited to a two-dimensional image and includes, for example, an image applied to a three dimensional object and a three dimensional object itself formed as a three-dimensionally molded image.

Although the exemplary embodiments are described with technical limitations with reference to the attached drawings, such description is not intended to limit the scope of the invention and all of the components or elements described in the exemplary embodiments of this disclosure are not necessarily indispensable to the present invention.

Referring now to the drawings, wherein like reference numerals designate identical or corresponding parts throughout the several views, exemplary embodiments of the present disclosure are described below.

Figure 2:
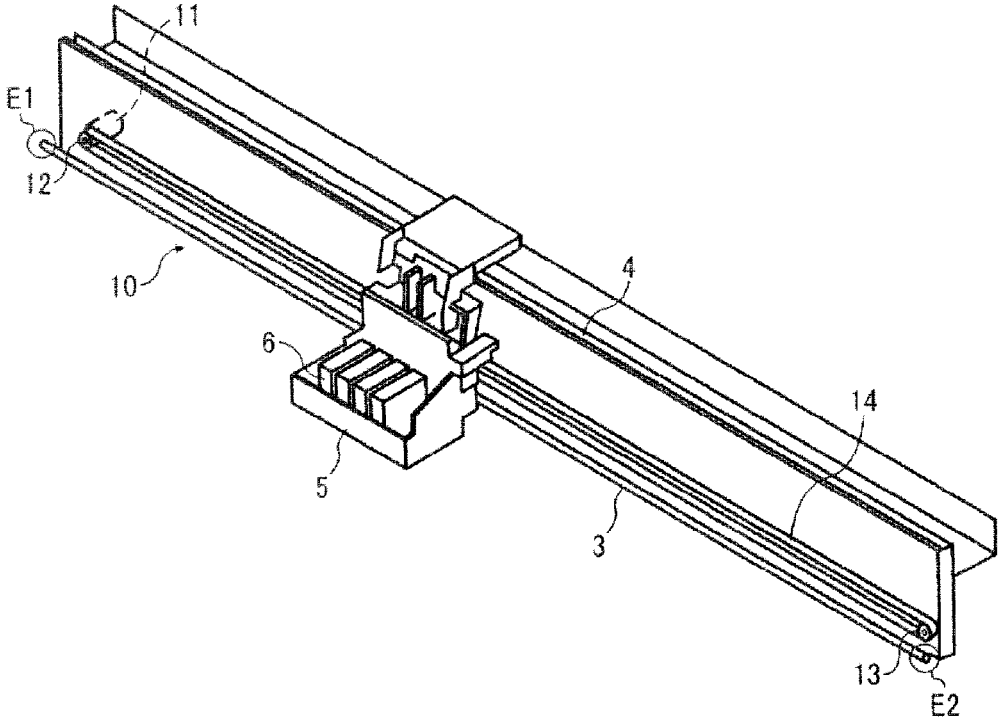
FIG. 2 is a perspective view of a carriage scanning mechanism of the image forming apparatus illustrated in FIG. 1.

First, an inkjet recording apparatus is described as an image forming apparatus according to an exemplary embodiment of this disclosure with reference to FIGS. 1 and 2.

FIG. 1 is a perspective view of an entire configuration of the inkjet recording apparatus. FIG. 2 is a perspective view of a carriage scanning mechanism of the inkjet recording apparatus.

In FIG. 1, the inkjet recording apparatus is a serial-type inkjet recording apparatus and has a main unit 1 and a support stand 2 to support the main unit 1.

The main unit 1 includes a guide rod 3 and a guide stay 4 that are extended between side plates. A carriage 5 is supported with the guide rod 3 and the guide stay 4 so as to be slidable along a main scanning direction indicated by an arrow A in FIG. 1. In other words, the guide rod 3 serves as a carriage guide member to guide movement of the carriage 5 along the main scanning direction, and the guide stay 4 serves as a support member to support the guide rod 3.

On the carriage 5 are mounded recording heads 6 serving as a liquid-ejection-type image forming unit for ejecting ink droplets of, for example, black (K), yellow (Y), magenta (M), and cyan (C). The recording heads 6 are integrally provided with head tanks that supply inks to the recording heads 6.

Although the image forming unit is described as liquid ejection head in this exemplary embodiment, the image forming unit is not limited to the liquid ejection head and may be any other type of image forming unit.

A carriage scanning mechanism (main scanning unit) 10 for moving the carriage 5 for scanning includes a driving motor 11 serving as a driving source disposed at one end in the main scanning direction, a driving pulley 12 rotated by the driving motor 11, a driven pulley 13 disposed at the opposite end in the main scanning direction, and a timing belt 14 serving as a carriage drawing member having ends extended between the driving pulley 12 and the driven pulley 13. A tension spring urges the driven pulley 13 outward (in a direction to move away from the driving pulley 12) to apply tension to the timing belt 14.

In a recording area of a main scanning region of the carriage 5, a suction conveyance unit 7 intermittently conveys a sheet 20 in a direction (sub-scanning direction, sheet conveyance direction) indicated by an arrow B in FIG. 1.

At one end of the main scanning region is disposed a maintenance-and-recovery unit 8 to maintain and recover good conditions of the recording heads 6. In addition, at an area outside the main scanning region of the carriage or at the opposite end of the main scan region, main cartridges 9 serving as main tanks are removably mounted to the main unit 1 to store color inks supplied to the head tanks of the recording heads 6 via an ink tube 61 serving as a liquid supply tube.

In FIG. 1, a roll sheet 20 (hereinafter, "sheet 20") is set on a sheet feeder 21. Alternatively, a roll sheet of a different width can be set on the sheet feeder 21. The sheet 20 fed from the sheet feeder 21 is conveyed with a conveyance device from a rear side to a front side of the apparatus to reach the recording area. While moving the carriage 5 in the main scanning direction and intermittently feeding the sheet 20, the inkjet recording apparatus ejects droplets from the recording heads 6 in accordance with image information to form a desired image on the sheet 20. After image formation, the sheet 20 is cut at a desired length and discharged to a discharge tray at the front side of the inkjet recording apparatus.

Next, a belt mount of the carriage of the inkjet recording apparatus is described with reference to FIGS. 3 to 5.

Figure 3:
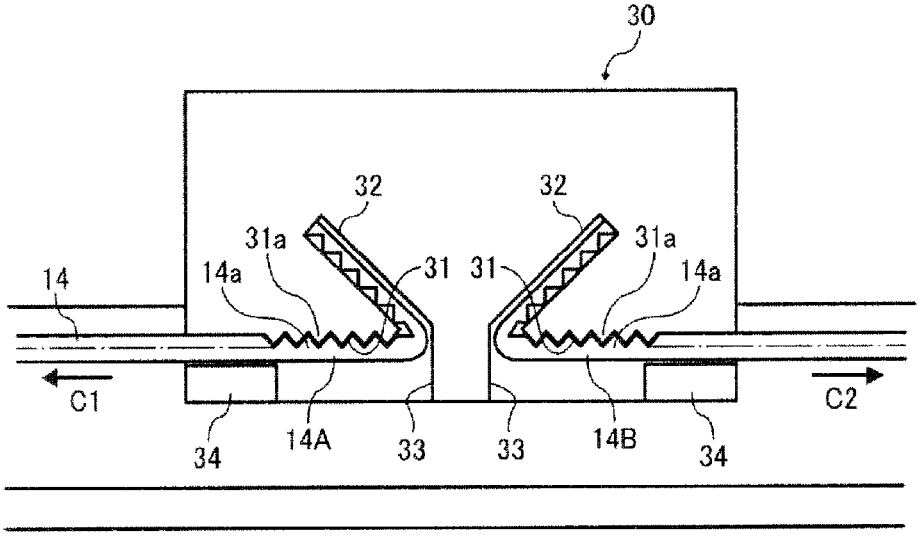
FIG. 3 is a front view of a belt mount of a carriage in a first exemplary embodiment in a state in which a timing belt is mounted to the belt mount.
Figure 4:
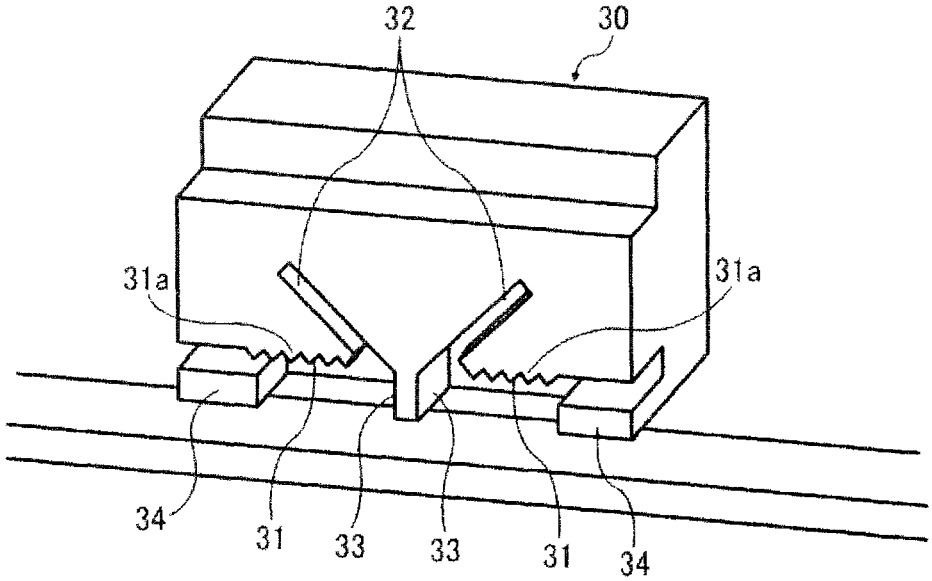
FIG. 4 is a perspective view of the belt mount of the carriage of FIG. 3.

FIG. 3 is a front view of the belt mount of the carriage at a state in which the timing belt is mounted on the belt mount of the carriage. FIG. 4 is a perspective view of the belt mount of the carriage of FIG. 3. FIG. 5 is a front view of the belt mount of the carriage.

On the back face of the carriage 5 (opposite the front face in which the recording heads 6 are disposed) is disposed a belt mount 30 serving as a drawing-member mount (coupling) member on which end portions 14A and 14B of a timing belt 14 serving as the open-ended drawing member are mounted.

The belt mount 30 has first engagement portions 31 with indented areas 31*a* to engage indented areas 14*a* of the timing belt 14 and second engagement portions 32 oriented so that the direction in which each of the second engagement portions 32 extends intersects the direction in which the corresponding one of the first engagement portions 31 extends. For example, in FIG. 3, the first engagement portions 31 are formed along the main scanning direction, and the second engagement portions 32 are formed so as to sharply fold back relative to the main scanning direction.

The second engagement portions 32 have grooves to engage with the timing belt 14. Unless the direction in which each of the second engagement portions 32 extends is on the same line as the direction in which the corresponding one of the first engagement portions 31 extends, the first engagement portions 31 may also be oriented at a desired angle relative to the main scanning direction.

Guide faces 33 are disposed between the first engagement portions 31 and the second engagement portions 32 to guide the timing belt 14 from the second engagement portions 32 to the first engagement portions 31. A portion between the guide faces 33 serves as a partition to divide the end portions 14A and 14B of the timing belt 14.

Figure 5:
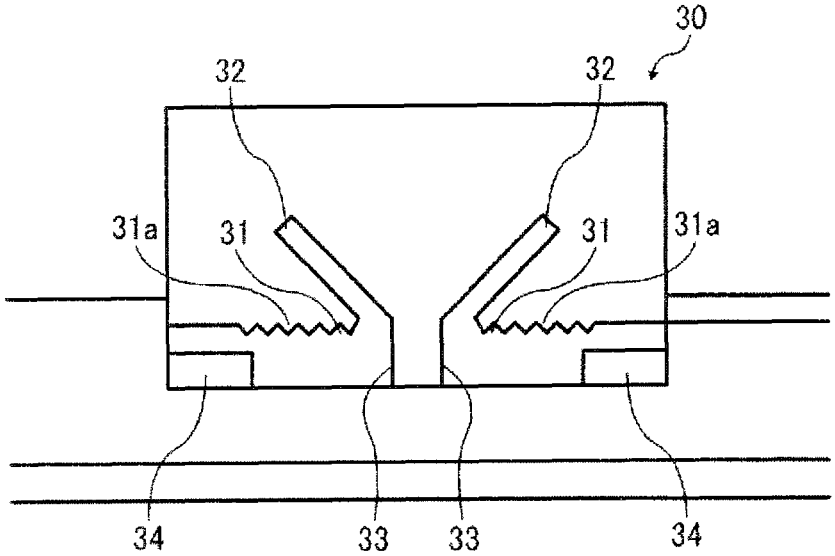
FIG. 5 is a front view of the belt mount of the carriage of FIG. 3.

As illustrated in FIG. 5, at an entry portion of each first engagement portion 31 (opposite the portion between the guide faces 33) is disposed an engagement assist portion 34 to restrict movement of the timing belt 14 in a direction to move away from the indented area 31*a* of the first engagement portion 31.

For such a configuration, as illustrated in FIG. 3, the end portions 14A and 14B of the timing belt 14 are engaged with the first engagement portions 31 and the second engagement portions 32, and the indented areas 14*a* of the timing belt 14 are engaged with the indented areas 31*a* of the first engagement portions 31. Thus, the timing belt 14 is mounted on the belt mount 30. As described above, the timing belt 14 can be mounted on the belt mount 30 simply by engaging the end portions 14A and 14B of the timing belt 14 with the first engagement portions 31 and the second engagement portions 32. Accordingly, the above-described configuration can facilitate the mounting of the open-ended timing belt to the carriage.

For example, when the timing belt 14 is drawn in a direction indicated by any of arrows C1 and C2 illustrated in FIG. 3 for the main scanning of the carriage 5, the engagement between the indented areas 14*a* of the timing belt 14 and the indented areas 31*a* of the first engagement portions 31 and the folding back of the second engagement portions 32 relative to the first engagement portions 31 prevent unintended disengagement of the end portions 14A and 14B from the first engagement portions 31 and the second engagement portions 32, thus allowing the timing belt to be reliably held by the carriage. In addition, as described above, the engagement assist portion 34 restricts movement of the timing belt 14 in the direction to move away from the indented areas 31*a*, thus reliably preventing unintended disengagement.

It is to be noted that the drawing-member mount of the carriage scanning mechanism is not limited to the above-described configuration and may be any other suitable configuration.

For the carriage scanning mechanism having the above-described configuration, when the carriage 5 is mounted to the guide rod 3 serving as the guide member, for example, a bearing portion 5*a* (see FIG. 6) of the carriage 5 is installed from one end E1 (or the opposite end E2) of the guide rod 3 illustrated in FIG. 2 and the carriage 5 is moved (slid) along the guide rod 3. The timing belt 14 is disengaged from the carriage 5, and one loop end of the timing belt 14 is set to the driving pulley 12 disposed near the one end E1 of the guide rod 3. The opposite loop end of the timing belt 14 is set to the driven pulley 13 disposed near the opposite end E2 of the guide rod 3.

In the installation of the timing belt 14, when the carriage 5 is slid along the guide rod 3, the long-length timing belt 14 mounted on the belt mount (drawing-member connecting member) may conflict with other components of the carriage scanning mechanism 10 and hamper smooth installation of the carriage.

Hence, in the following exemplary embodiments, the carriage has a holder and a guide support member to hold portions of the timing belt (carriage drawing member) 14, thus minimizing conflict of the timing belt 14 with other components of the carriage scanning mechanism 10.

Next, a first exemplary embodiment of the present disclosure is described with reference to FIGS. 6 and 7.

Figure 6:
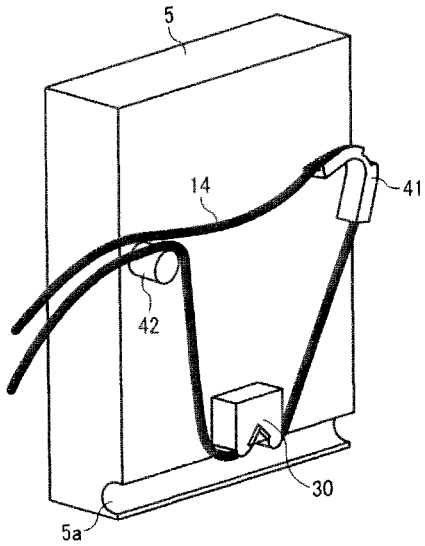
FIG. 6 is a perspective view of the carriage in the first exemplary embodiment.

FIG. 6 is a perspective view of the carriage in the first exemplary embodiment. FIG. 7 is a back view of the carriage illustrated in FIG. 6.

The belt mount 30 is mounted at the back side of the carriage 5. Unlike the above-described embodiment, for the belt mount 30 in this exemplary embodiment, fitting portions 30*a* into which the end portions of the timing belt 14 are fitted are arranged in a mountain form at a lower portion of the belt mount 30.

The carriage 5 has a semi-U-shaped holder 41 on the back face to hook a portion of the timing belt 14 extended from the belt mount 30 during installation and a support guide member 42 to support and guide portions of the timing belt 14 extended from the belt mount 30 and the holder 41 during installation.

The holder 41 is disposed at a position higher than the belt mount 30 in the height direction of the carriage 5 and at one end portion of the carriage 5 in the main scanning direction. The holder 41 has a curved shape to hook the timing belt 14 on and guide the timing belt 14 toward a center position in the main scanning direction of the carriage 5.

A tangent line to a bent portion 30*b* of the belt mount 30 is on the same line as a tangent line to the curved holder 41, and the bent portion 30 of the holder 41 has a smoothly curved shape. Such a configuration increases the area in which the timing belt 14 contacts the holder 41, thus minimizing the load on the timing belt 14.

Figure 7:
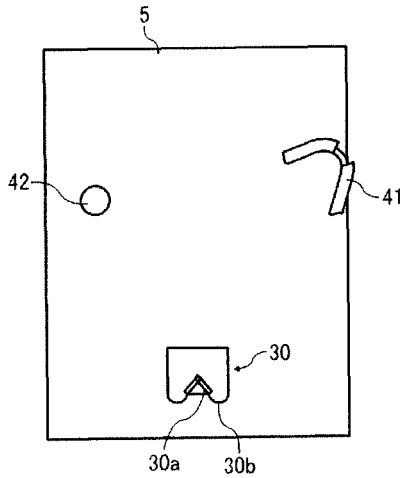
FIG. 7 is a back view of the carriage illustrated in FIG. 6.

As illustrated in FIG. 7, the holder 41 partially protrudes outward from the outer circumferential surface of the carriage 5. Such a configuration makes the timing belt 14 hooked on the holder 41 visible from the front side of the carriage 5, thus allowing an operator to easily remove the timing belt 14 from the holder 41 from the front side of the carriage 5.

Figure 8A:
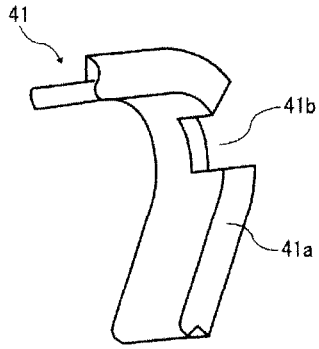
FIGS. 8A and 8B are perspective views of a holder of the carriage.
Figure 8B:
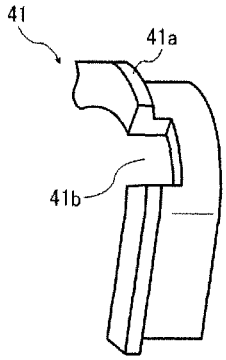

As illustrated in FIGS. 8A and 8B, the holder 41 has a flange portion 41*a* to prevent unintended detachment of the timing belt 14.

The holder 41 also has a cutout portion 41*b* into which an operator can insert his/her finger. Such a configuration allows the operator to easily remove the timing belt 14 from the holder 41. The cutout portion 41*b* is disposed at a position visible from the front side of the carriage 5.

On the back face of the carriage 5, the support guide member 42 to support and guide the timing belt 14 extended from the belt mount 30, and the holder 41 is disposed at an end portion opposite the holder 41 in the main scanning direction. In FIG. 7, the single support guide member 42 is disposed at the back face of the carriage 5. Alternatively, the number of the support guide member 42 may be two or more.

The support guide member 42 is disposed at a position higher than the belt mount 30 in the height direction of the carriage 5. Components of the carriage scanning mechanism 10 that might conflict with the timing belt 14 in installing the carriage 5 are disposed at positions lower than the bottom of the carriage 5. Accordingly, the timing belt 14 that would otherwise hang down by gravity is supported at the position higher than the belt mount 30, thus minimizing conflict of the timing belt 14 with the components of the carriage scanning mechanism 10.

For such a configuration, as illustrated in FIG. 6, in installing the carriage 5, the ends of the timing belt 14 are fitted into the belt mount 30 of the carriage 5. Then, one end portion of the timing belt 14 extended from the belt mount 30 is hooked around the holder 41 and supported with the support guide member 42, and an opposite end portion of the timing belt 14 extended from the belt mount 30 is directly hooked on the support guide member 42.

The bearing portion 5*a* of the carriage 5 is put on the guide rod 3 from one end portion of the guide rod 3 and the carriage 5 is moved (slid) along the guide rod 3. At this time, the timing belt 14 is hooked on the holder 41 and supported with the support guide member 42, thus allowing smooth movement of the carriage 5 while preventing the timing belt 14 from hanging below the carriage 5. Then, the carriage 5 is moved to a desired position, and the timing belt 14 is removed from the holder 41 from the front side of the carriage 5 and hooked around the driving pulley 12. The timing belt 14 is also removed from the support guide member 42 and hooked around the driven pulley 13.

As described above, in this exemplary embodiment, the carriage has the drawing-member mount on which the drawing member for drawing the carriage is mounted, the holder to hook the drawing member extended from the drawing-member mount during installation, and the support guide member to support and guide the drawing member extended from the drawing-member mount and the hook portion. Such a configuration allows the drawing member to be hooked on the holder and guided with the support guide member in installing the carriage to the carriage guide member of the main unit with the carriage being mounted to the drawing member, thus facilitating the installation of the long-size drawing member.

Next, a second exemplary embodiment of the present disclosure is described with reference to FIGS. 9 and 10.

Figure 9:
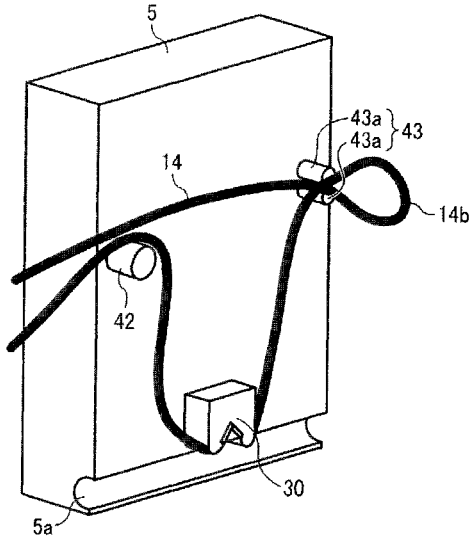
FIG. 9 is a perspective view of a carriage in a second exemplary embodiment.
Figure 10:
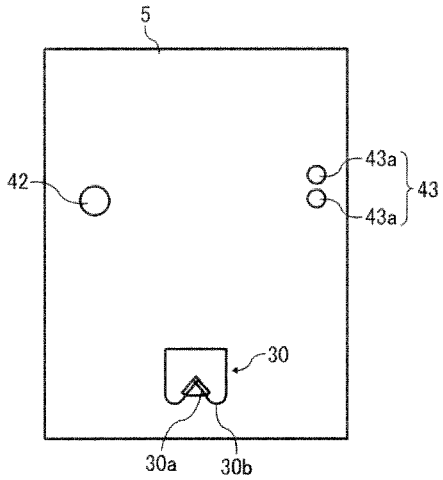
FIG. 10 is a back view of the carriage illustrated in FIG. 9.

FIG. 9 is a perspective view of a carriage in the second exemplary embodiment. FIG. 10 is a back view of the carriage illustrated in FIG. 9.

In this exemplary embodiment, a holder 43 includes two hollow or solid cylindrical members 43*a* serving as a pair of opposed clasping members that are disposed away from each other with a certain clearance. As illustrated in FIG. 9, the holder 43 clasps the timing belt 14 between the cylindrical members 43*a* to hold the timing belt 14. To facilitate removal of the timing belt 14 from the holder 43, the timing belt 14 is clasped with the cylindrical members 43*a* so that a portion 14*b* of the timing belt 14 protrudes from an outer surface of the carriage 5, thus making the portion 14*b* of the timing belt 14 visible from the front side of the carriage 5.

Such a configuration can obtain effects equivalent to those of the first exemplary embodiment.

Next, a third exemplary embodiment of the present disclosure is described with reference to FIG. 11.

Figure 11:
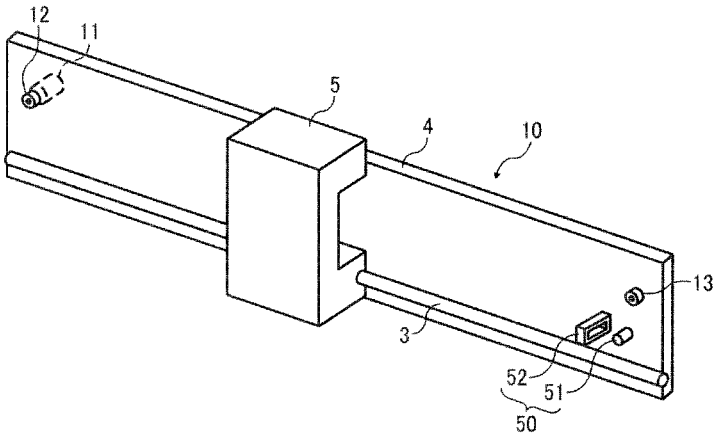
FIG. 11 is a perspective view of a carriage scanning mechanism in a third exemplary embodiment.

FIG. 11 is a perspective view of a carriage scanning mechanism in the third exemplary embodiment.

In this exemplary embodiment, a guide stay 4 of the carriage scanning mechanism 10 has a temporary holder 50 to temporarily hold the timing belt 14 extended from the support guide member 42 of the carriage 5. The temporary holder 50 also serves as a guide member to guide the timing belt 14 and has a hanging member 52 to insert a folded portion of the timing belt 14 through and a cylindrical member 51 to hook the folded portion of the timing belt 14 inserted through the hanging member 52. Such a configuration allows the timing belt 14 to be temporarily held at the guide stay 4 of the carriage scanning mechanism 10, thus preventing twist of the timing belt 14 during installation and facilitating the installation of the long-size timing belt 14.

Next, a fourth exemplary embodiment of the present disclosure is described with reference to FIGS. 12 to 14.

Figure 12:
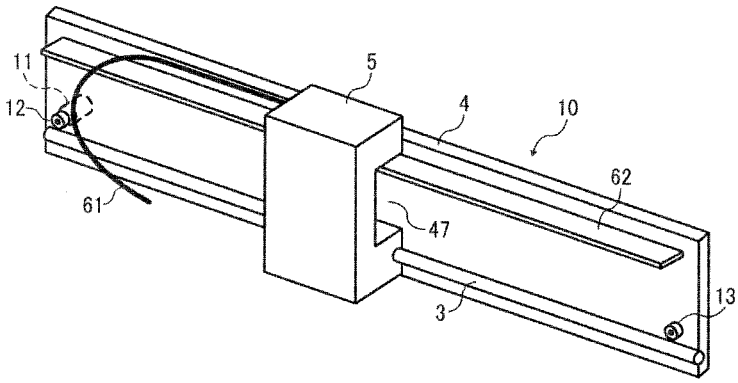
FIG. 12 is a perspective view of a carriage scanning mechanism in a fourth exemplary embodiment.

FIG. 12 is a perspective view of a carriage scanning mechanism in the fourth exemplary embodiment. FIG. 13 is a back view of the carriage scanning mechanism illustrated in FIG. 12. FIG. 14 is a side view of the carriage scanning mechanism illustrated in FIG. 12.

As described above, the recording heads 6 integrated with the head tanks are mounted on the carriage 5. As illustrated in FIG. 12, inks are supplied from the main cartridges 9 to the head tanks via the ink tube 61 serving as the liquid supply tube. The ink tube 61 is bent in a substantially C shape seen from above the main unit 1, and one end portion of the ink tube 61 is mounted to the carriage 5.

To prevent the ink tube 61 from hanging down to a movable range of the carriage 5, a tube guide member 62 for guiding the ink tube 61 is disposed so as to protrude from the guide stay 4 toward the carriage 5.

The carriage 5 has a recess 47 corresponding to the tube guide member 62 protruding toward the carriage 5. A holder 45 is disposed at the recess 47 to hook the timing belt 14 on. In this exemplary embodiment, the holder 45 is integrally molded with the carriage 5. In addition, in consideration of the easiness of molding and cost reduction, the holder 45 has, for example, a rectangular shape.

Figure 13:
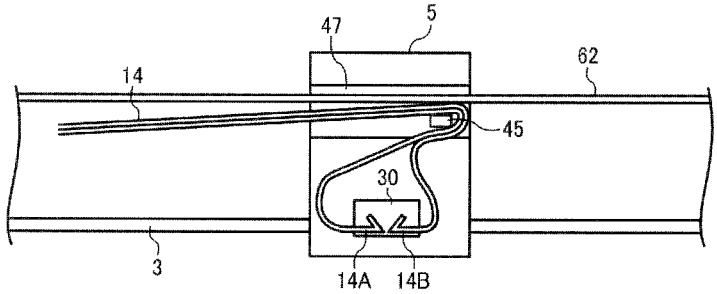
FIG. 13 is a back view of the carriage scanning mechanism illustrated in FIG. 12.

In this exemplary embodiment, unlike the above-described exemplary embodiment, as illustrated in FIG. 13, two portions of the timing belt 14 extended from the end portions 14A and 14B are collectively hooked on the holder 45.

In FIG. 13, the single holder 45 is formed at the right side on the back face of the carriage 5. The reason of this arrangement is that the carriage 5 is installed from the right side of FIG. 12 and moved to the left side while carrying the timing belt 14. By contrast, in a case in which the carriage 5 is moved from the left side to the right side, the holder 45 is preferably formed at the left side on the back face of the carriage 5.

Figure 14:
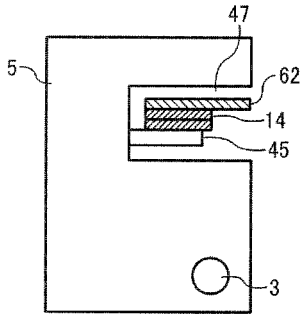
FIG. 14 is a side view of the carriage scanning mechanism illustrated in FIG. 12.

As illustrated in FIG. 14, the tube guide member 62 is arranged so as to form a clearance between the holder 45 and an upper wall surface of the recess 47 of the carriage 5, thus allowing the timing belt 14 to be guided in a state in which two portions of the timing belt 14 are stacked on the holder 45. This clearance has a size capable of preventing twist of the timing belt 14 while moving the carriage 5 from the right side to the left side in FIG. 12 to carry the timing belt 14.

Hence, as described above, by moving the carriage 5 from the right side to the left side in FIG. 12, the timing belt 14 is carried to the left side while being guided by the tube guide member 62. Then, the timing belt 14 is removed from the carriage 5, and one loop end of the timing belt 14 is set to the driving pulley 12, and the opposite loop end of the timing belt 14 is set to the driven pulley 13.

As described above, the tube guide member 62 performs two functions of guiding the timing belt 14 and preventing hanging down of the ink tube 61, thus simplifying the configuration of the holder 45 of the carriage 5.

In the above-described exemplary embodiments, the drawing member for drawing the carriage is described taking the example of the timing belt. It is to be noted that the drawing member for drawing the carriage is not limited to the timing belt and may be, for example, a wire or stainless steel (SUS) plate. In addition, although the open-ended drawing member is employed in the above-described exemplary embodiments, an endless drawing member is similarly applicable to the carriage scanning mechanism.

The above-described configuration of the belt mount of the carriage is also applicable to, for example, a scanning unit of moving a reading head of an image reading device.

Numerous additional modifications and variations are possible in light of the above teachings. It is therefore to be understood that, within the scope of the appended claims, the present disclosure may be practiced otherwise than as specifically described herein. With some embodiments having thus been described, it will be obvious that the same may be varied in many ways. Such variations are not to be regarded as a departure from the scope of the present disclosure and appended claims, and all such modifications are intended to be included within the scope of the present disclosure and appended claims.

What is claimed is:

1. An image forming apparatus, comprising:

a carriage movably supported to move reciprocally in a main scanning direction;

an image forming unit mounted on the carriage to form an image;

a driving pulley disposed at a first end in the main scanning direction;

a driven pulley disposed at a second end opposite the first end in the main scanning direction;

a driving source operatively connected to the driving pulley to rotate the driving pulley;

a carriage drawing member extended between the driving pulley and the driven pulley and partially mounted to the carriage to draw the carriage;

a mount disposed on the carriage to mount the carriage drawing member;

a holder disposed on the carriage to hook the carriage drawing member extended from the mount during assembly; and a guide member to guide the carriage drawing member extended from the mount and the holder, wherein each of the mount, the holder and the guide member is attached to a common surface of the carriage, said common surface facing the carriage drawing member.

2. The image forming apparatus according to claim 1, wherein the guide member is disposed at a position higher than the mount in a height direction of the carriage.

3. The image forming apparatus according to claim 1, wherein the holder protrudes outward from an outer surface of the carriage.

4. The image forming apparatus according to claim 1, wherein the holder has a cutout.

5. The image forming apparatus according to claim 1, wherein the holder comprises a pair of opposed clasping members to clasp the carriage drawing member.

6. The image forming apparatus according to claim 1, wherein the guide member is disposed at the carriage.

* * * * *

UNITED STATES PATENT AND TRADEMARK OFFICE

CERTIFICATE OF CORRECTION

PATENT NO. : 8,591,002 B2
APPLICATION NO. : 13/225737
DATED : November 26, 2013
INVENTOR(S) : Kenji Shimizu et al.

It is certified that error appears in the above-identified patent and that said Letters Patent is hereby corrected as shown below:

Replace item (75) on the title page of the patent with the following:

-- (75) Inventors: Kenji Shimizu, Kanagawa (JP);
Takayuki NIIHARA, Kanagawa (JP);
Shinichiro NARUSE, Kanagawa (JP);
Soichi SAIGA, Tokyo (JP) --

Signed and Sealed this
Twenty-second Day of April, 2014

Michelle K. Lee

Michelle K. Lee
*Deputy Director of the United States Patent and Trademark Office*